US011304266B2

(12) United States Patent
Crandell

(10) Patent No.: US 11,304,266 B2
(45) Date of Patent: Apr. 12, 2022

(54) ELECTRIC HEATER CRUSHABLE CORES AND COMPACTED UNITARY HEATER DEVICES AND METHOD FOR MAKING SUCH DEVICES

(71) Applicant: Walter Crandell, St. Charles, IL (US)

(72) Inventor: Walter Crandell, St. Charles, IL (US)

( * ) Notice: Subject to any disclaimer, the term of this patent is extended or adjusted under 35 U.S.C. 154(b) by 365 days.

(21) Appl. No.: 16/247,401

(22) Filed: Jan. 14, 2019

(65) Prior Publication Data

US 2019/0150228 A1 May 16, 2019

Related U.S. Application Data

(62) Division of application No. 13/979,354, filed as application No. PCT/US2012/021453 on Jan. 16, 2012, now Pat. No. 10,182,471.

(60) Provisional application No. 61/433,497, filed on Jan. 17, 2011.

(51) Int. Cl.
*H05B 3/46* (2006.01)
*H01C 17/02* (2006.01)
*H01C 17/04* (2006.01)

(52) U.S. Cl.
CPC ..... *H05B 3/46* (2013.01); *H01C 17/02* (2013.01); *H01C 17/04* (2013.01); *H05B 2203/014* (2013.01); *Y10T 29/49083* (2015.01); *Y10T 29/49089* (2015.01); *Y10T 29/49096* (2015.01)

(58) Field of Classification Search
CPC .. H01C 17/02; H01C 17/04; H05B 2203/014; H05B 3/46; Y10T 29/49083; Y10T 29/49089; Y10T 29/49096
USPC ..... 219/534, 227, 229, 238, 241, 242, 438, 219/535, 541, 543, 544, 552, 553, 218, 219/248
See application file for complete search history.

(56) References Cited

U.S. PATENT DOCUMENTS 2,831,951 A * 4/1958 Desloge ..... H05B 3/46 338/241
4,035,613 A * 7/1977 Sagawa ..... H05B 3/18 219/552
2004/0211771 A1* 10/2004 Crandell ..... H05B 3/44 219/544

(Continued)

*Primary Examiner* — Dana Ross
*Assistant Examiner* — Ket D Dang
(74) *Attorney, Agent, or Firm* — James Michael Faier; Faier & Faier P.C.

(57) ABSTRACT

A crushable ceramic heater core for an electric heater device which has a cylinder-like body of crushable ceramic material and grooves along the periphery of the body, the grooves being key shaped and adapted to receive a conductive pin in a groove. The invention also includes an electric heater device where such a core has been wound with heater wire and the conductive pin has been inserted in a core groove in contact with the wire, and the wire wound core has been installed in a sheath which has been filled with electoral insulating material. The sheath and its contents are swaged to create a compacted unitary heater assembly. The invention also includes the process for making the wire wound grooved core having a conductive pin therein in contact with the wire winding, and a method for making a heating device having such a core and which has been compacted to a theoretical density. The heater assembly and the method may also include installation of temperature sensing devices.

4 Claims, 6 Drawing Sheets

(56) References Cited

U.S. PATENT DOCUMENTS

2009/0032519 A1* 2/2009 Schlipf ..... H05B 3/48
219/209

* cited by examiner

Fig. 1
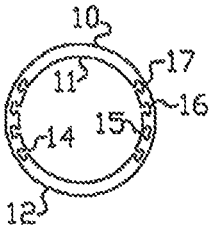
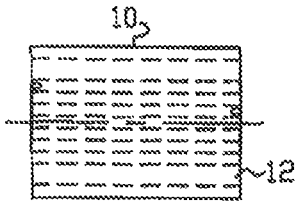
Fig. 2
Fig. 3
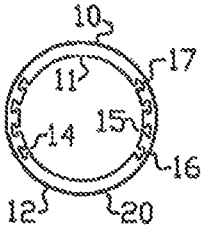
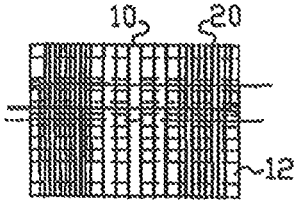
Fig. 4
Fig. 5
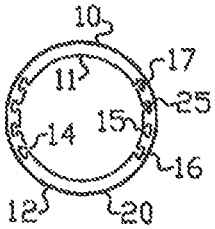
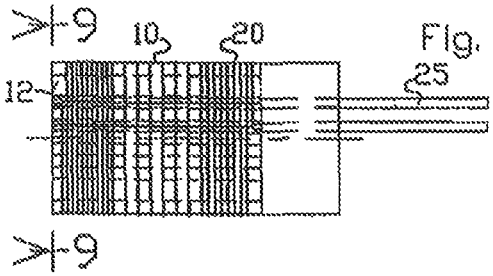
Fig. 6
Fig. 7
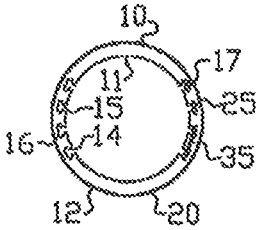
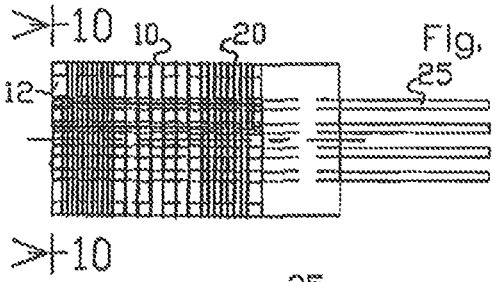
Fig. 8
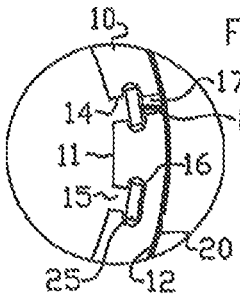
Fig. 9
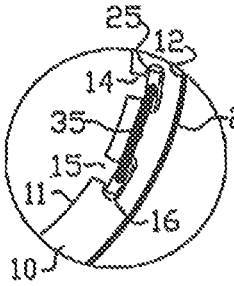
Fig. 10

Fig. 13
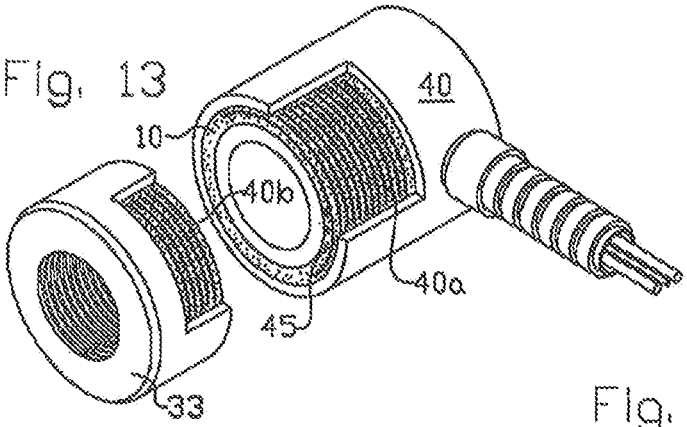
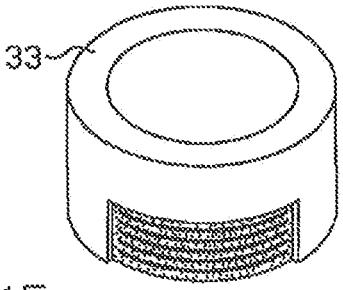
Fig. 15
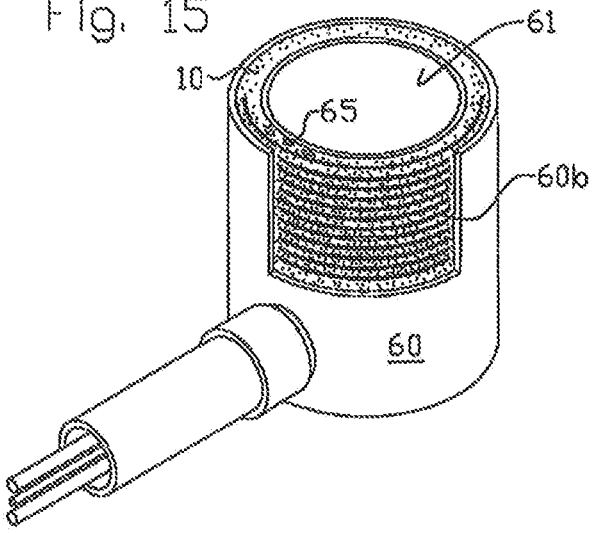
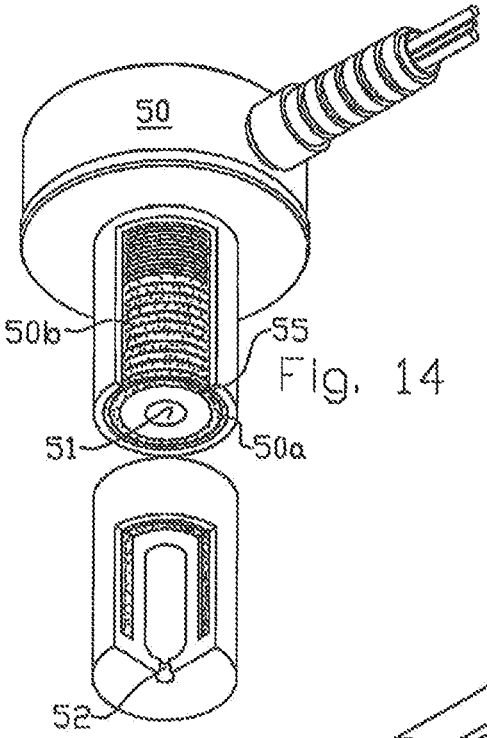
Fig. 14
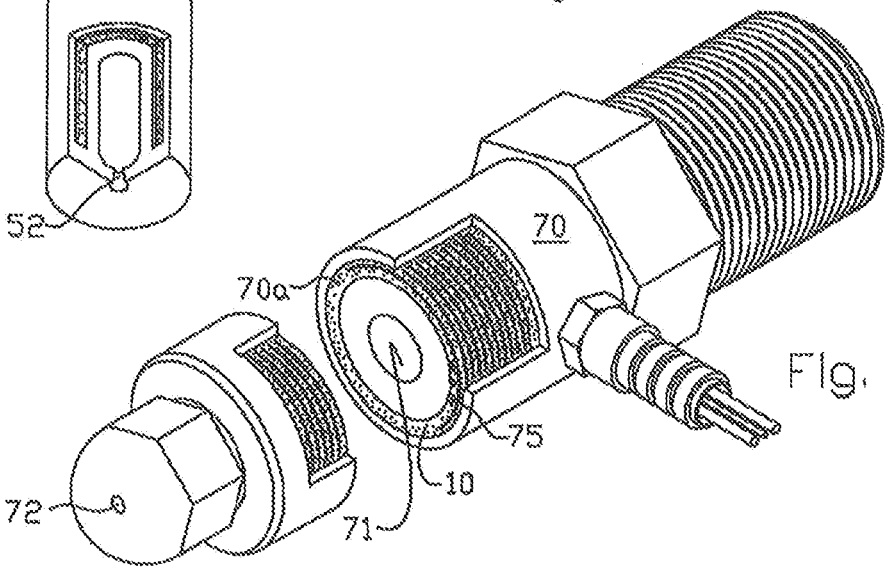
Fig. 16

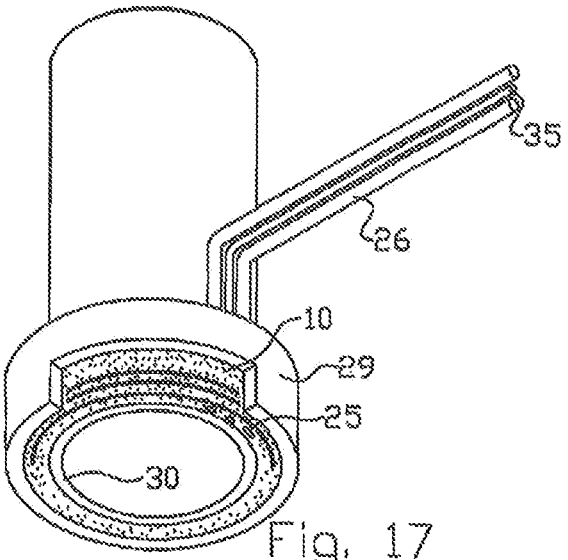
Fig. 17
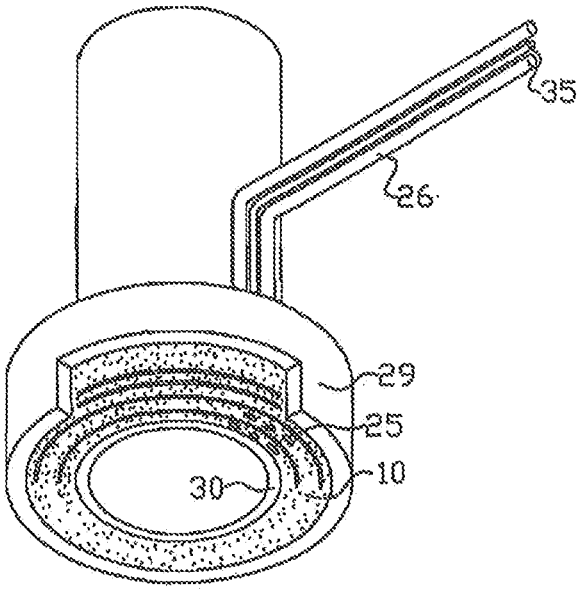
Fig. 18
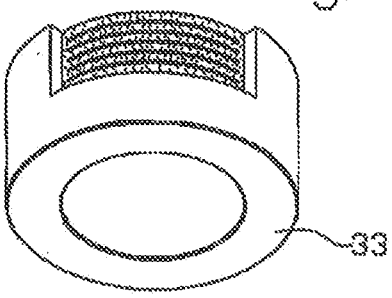
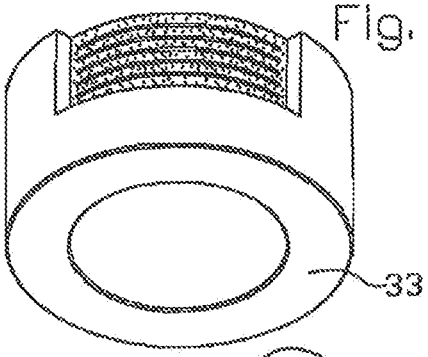
Fig. 19
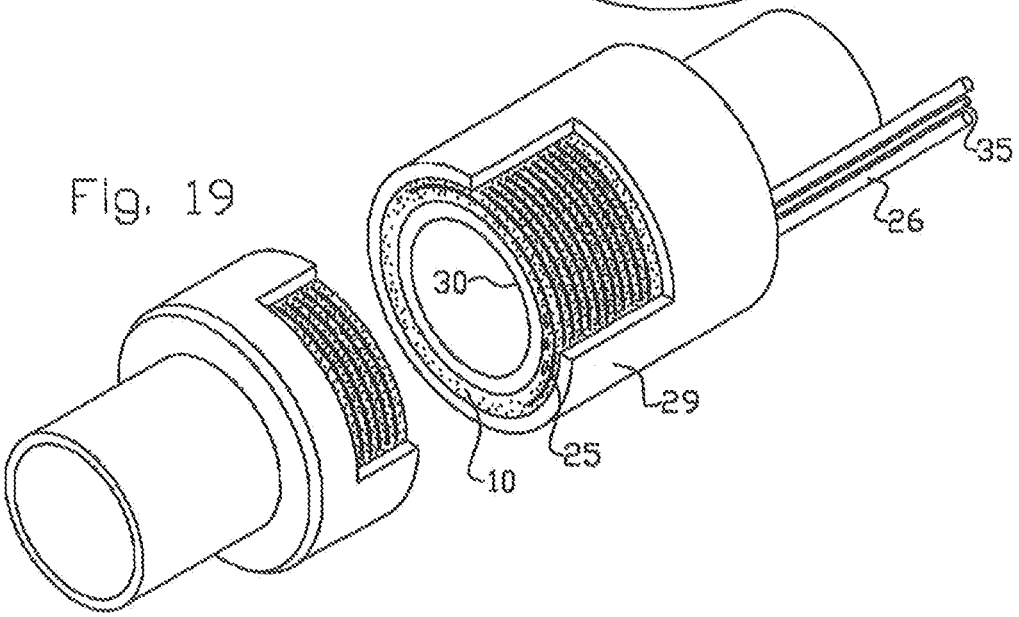

ELECTRIC HEATER CRUSHABLE CORES AND COMPACTED UNITARY HEATER DEVICES AND METHOD FOR MAKING SUCH DEVICES

PRIORITY CLAIM

Priority is claimed from U.S. Provisional Application No. 61/433,497, filed Jan. 18, 2011 and Patent Cooperation Treaty case number PCT/US2012/021453 filed Jan. 16, 2012.

BACKGROUND AND SUMMARY OF THE INVENTION

This invention relates to a crushable heater core for an electric heater device, a compacted unitary electric heater device, and a method for making such devices. Such devices include, without limitation, swaged sleeve heaters, often in a hollow tube-like configuration, for delivering or processing material, such as plastic or other molten material, within or exterior to such a tube-like structure, for forming plastics, food processing, packaging, glue or other dispensing operations, in aerospace, liquid metal transfer, die casting, chemical, liquid processing, glass processes, gas heating equipment and other processes where close control is required. Such heaters can be constructed with sheaths of tool or stainless steel, super alloys and other critical materials, and may have special purpose coatings where required.

Heater devices embodying the present invention offer heat transfer and performance characteristics and superior dielectric properties not found in conventional devices. The construction and design of such novel devices permit easy and effective control and performance enhancement, and may be constructed with distributed wattage, multiple independent heat zones, one or more integral thermocouples and singular or multiple thermowells which may accommodate sheathed, mineral insulated thermocouples for easy insertion or removability.

Devices embodying the present invention utilize a novel cylindroid crushable ceramic core which has key hole shaped grooves on its interior surface for receiving lead pins in communication with a winding of electric heating wire, and the wound core is entrained in upper and lower sleeves and swaged to provide electrical contact between the lead pins and the heater element wire.

The unique heating element embodying the present invention starts with one or more novel crushable ceramic core(s) of special configuration. Such core(s) comprises a cylindroid or cylinder which is fabricated with key hole shaped longitudinal grooves along their internal circumferential periphery. The entry to a groove comprises a keyhole like slot which is narrower at its entry and enlarged as it enters the circumferential wall of the cylindroid or cylinder. This keyhole slot may have a cross section which is rectangular or oblong or pillow shaped as long as its interior is of greater cross-section than its keyhole entry.

The crushable ceramic core or cores are wound with heating element wire. The wire windings can be spaced as to provide distributed wattage, or cold zones on each core. The lead and terminal ends of the heating element wire are threaded into the cores in alignment with selected key slots. Selected alternate key slots in one or more cores of a multi-core assembly permits creation of independently powered cores to provide independently heated zones. Unwound cores can be placed at the ends of the core assembly or between multiple cores to provide additional cold zones to meet application or lead termination needs.

A conductive pin having a cross section substantially conforming to the cross section of a key slot is slid into each groove having a heated wire end intersection with the groove, so that a pin and wire end contact one another.

If thermowells for use with separate thermocouple sensors or thermocouple wires to create sensors for heat control are desired, they may be installed in one of the grooves.

The interior of the wire wound ceramic core and arranged pin assembly is slid into a first tube like or solid metal sleeve and within a second outer metal sleeve so that the wire wound ceramic core and arranged pin assembly is sandwiched between the first and second metal sleeves. Preferably, the first inner sleeve is sized to accommodate the wire wound ceramic core to permit easy sliding of the core into place.

Magnesium Oxide or similar insulating power is poured into the space between the core and the sleeves and the assembly is vibrated until the space between the parts is full and compacted to the extent possible by vibration.

A tool rod or tube is inserted into or over the inner tube-like or solid sheath sleeve, and the assembly is inserted into a swaging machine and subjected to circumferential hammering until the outer diameter of the assembly is reduced to a size which compacts the internal ceramic core and insulating ceramic powder to near theoretical maximum density so that the connection between each of the pins and its associated element wire end is substantially unitized for effective electrical connection and that the ceramic powder in the key slots between the pin and the inner sleeve is compacted to provide the required electrical insulation properties between the pin and inner tube-like or solid metal sleeve.

Objects and Advantages of the Invention

Compacted electric heating devices utilizing the novel core arrangement described constructed according to the present invention have the following attributes, objects and advantages:

(a) They are more durable than conventional heaters because their high temperature heating element assemblies are imbedded in ceramic insulation compacted to near theoretical density providing optimum life and performance at temperatures up to 1600° F.

(b) They have optimum thermal and electrical properties because their swaged or compacted construction maximizes heat transfer while providing superior dielectric and insulation resistance.

(c) They can be constructed with thin total element and sheath wall sections to permit installation in restricted areas of tooling or with thin element wall and thick sheath wall sections to provide high strength for high pressure and mechanically demanding applications.

(d) They can be manufactured with large inside diameters, exceeding two inches, with a comparatively thin wall section and maintaining the desired dielectric and heat transfer properties.

(e) They are adequately versatile to accommodate simple sleeve heater arrangements or machined into sophisticated engineered configurations, with customized inner bores and precision fits, (f) They have a construction which is capable of distributed wattage configurations to support multiple heating conditions along the length of the heater.

(g) They permit independent heat zones to be created.

(h) They provide superior heat uniformity circumferentially and longitudinally.

(i) They are capable of supporting optional custom coatings, special lead systems, and a wide selection of sensor options.

Heaters embodying the present invention can be used in many kind of industries and systems, such as runnerless and injection molding systems, thermoplastic and thermoset plastic processing environments, blow molding, die casting, glass processing, sintering and curing equipment, extrusions, sealing heads, film rollers, plastic welding, branding, heater rollers, high temperature equipment, liquid and gas processing, brazing, soldering and steam equipment, among most other controlled heating requirements.

BRIEF DESCRIPTION OF THE DRAWINGS

In the drawings:

FIG. 1 is an end elevation view of a formed grooved crushable ceramic core embodying the present invention.

FIG. 2 is a side elevation view of the core shown in FIG. 1, with the grooves shown in dotted lines.

FIG. 3 is an end elevation view of the core shown in FIG. 1 which has been wound with heater element wire.

FIG. 4 is a side elevation view of the wire wound core shown in FIG. 3.

FIG. 5 is an end elevation view of part of the wire wound core shown in FIG. 3 with power pins installed.

FIG. 6 is a side elevation view of a modified sleeve heater assembly with power pins installed.

FIG. 7 is an end elevation view of a modified sleeve heater assembly with a thermocouple arranged in the crushable ceramic wind core and cold core.

FIG. 8 is a side elevation view of a modified sleeve heater assembly with a thermocouple arranged in the crushable ceramic wind core and cold core.

FIG. 9 is a detail enlarged end view of the power pin and resistance wire element connection for the sleeve heater assembly shown in FIG. 6.

FIG. 10 is a detail enlarged end view of the thermocouple pin connection for the modified sleeve heater assembly shown in FIG. 8.

FIG. 13 is a perspective isometric view of an integral heated melt transfer tube for liquid metal and plastic made according to the present invention, broken apart to show its constituent layers.

FIG. 14 is a perspective isometric view of an integral heated sprue bushing for plastic molding made according to the present invention, broken apart to show its constituent layers.

FIG. 15 is a perspective isometric view of an integral heated melt pot container made according to the present invention, broken apart to show its constituent layers.

FIG. 16 is a perspective isometric view of an integral heated molding machine nozzle made according to the present invention, broken apart to show its constituent layers.

FIG. 17 is a perspective isometric view of an integral heated heat sealing head made according to the present invention, broken apart to show its constituent layers, FIG. 18 is a perspective isometric view of an integral heated heat sealing head with novel concentric layers of windings and pins provided to concentrate and more uniformly balance heat over a larger required end sealing surface, made according to the present invention, broken apart to show its constituent layers.

FIG. 19 is a perspective isometric view of an integral heated heat sealing roller made according to the present invention, broken apart to show its constituent layers.

DETAILED DESCRIPTION OF PREFERRED EMBODIMENTS

Figure 11:
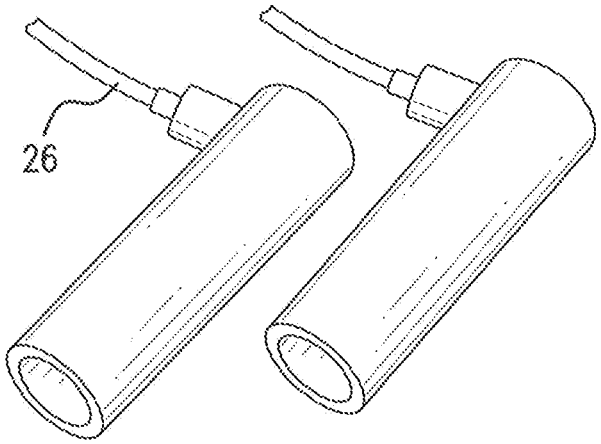
FIG. 11 is a photograph of two finished heaters embodying the invention.
Figure 11A:
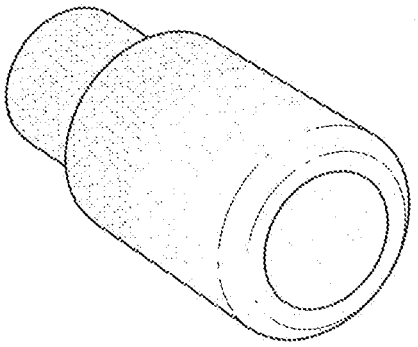
FIG. 11A is a photograph of the heated tip of a heater.
Figure 12:
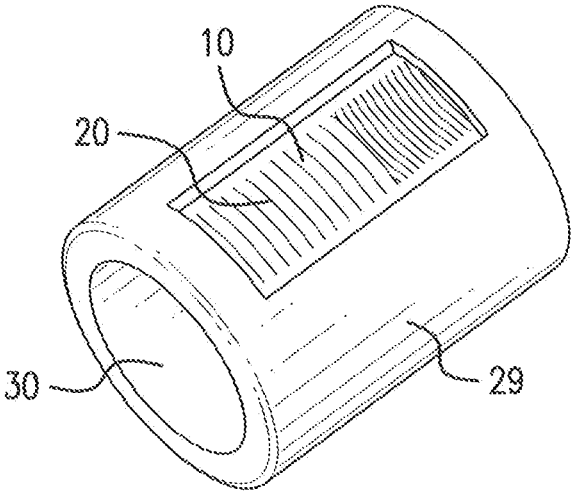
FIG. 12 is a photograph of a heater sleeve embodying the present invention with sections cut away to show the interior of the heater sleeve, with the crushable ceramic core and MGO insulating powder and electrical components compacted by swaging.

With reference to the accompanying drawing and particularly to FIGS. 1-5, the crushable ceramic core 10 illustrated in FIG. 1 consists of a cylindrical or cylindroid device with an inner circumferential wall 11 and an outer circumferential wall 12, and having on its inner circumference a series of longitudinal arranged parallel grooves or key slots 14. Each of these key slots 14 has an entry 15 on the inner circumference wall 11 of the core 10 of reduced radius leading to an inner enlarged section 16. The enlarged section 16 of each slot 14 is preferably oblong and wider than it is deep. At least two of these slots have a groove 17 extending from the outer circumferential surface 12 of the core 10, one groove communicating with the enlarged section 16 of one slot 17 and another communicating with the enlarged section 16 of another slot 17.

Heater resistance wire 20 is wound around the outer or exterior circumference 12 of the core 10 in any selective arrangement depending upon the use and electrical requirements of the heater, which may be constructed to provide constant wattage, distributed wattage, sectional heating, and with or without cold sections. One end 21 of the heater wire 20 is threaded into one of the slots or grooves 17 communicating with a core key slot 14 and the other end 22 of the heater wire 20 is threaded into another slot communicating with another core key slot. If the heat provided by a finished heater is to be varied, other pairs of grooves 17 may be slotted and other ends of the heater wire for the varied arrangements may be inserted into other key slots 14 to achieve the selected heating arrangements desired.

A conductive pin 25, preferably having a substantially rectangular cross section but a bit smaller than the enlarged section 16 of a key slot 14 is threaded into each of the preferably oblong or enlarged sections 16 of a selected key slot in alignment and communicating with the end 21 or 22 on a winding of heater wire 20. This conductive pin 25 may be as long as the key slot 14 or of a different length, depending upon the end use of the finished heater. The pin 25 must be long enough to communicate with electrical leads 26 exterior to the heater, of a length depending upon the end use of the finished heater device.

An inner tube-like or solid sheath 30 is slipped into the central inside circumferential wall of the wire wound core 10 with its pins 25 in place, and an outer sheath 29 is slipped over the outer circumferential wall 12 of the wire would core 10. These sheaths 29 and 30 may have relatively heavy walls and are preferably constructed of tool steel, stainless steel or similar heat transmitting material, and are substantially at least as long as the wire wound heater core 10.

At this point magnesium oxide insulation powder of fine sand-like consistency or similar insulating material is poured into all voids within the assembly. The open area of the key slots 14 also function as fill channels for the insulating material. The assembly is vibrated to pack the insulating material within the sheaths 29 and 30 and assembly of the core 10, key slots 14, pins 25 and winding of heater wire 20 substantially as much as possible.

Following this packing and vibrating step, a round shaft (not shown) longer than the sheaths enclosing the wire wound core assembly is fit into or over the inner sheath. The assembly is swaged until a predetermined diameter for the assembly has been reached. Upon swaging, the core is crushed, the core and insulation are compacted to a near theoretical density, the pin and wire connection is secured, the key slot entry is collapsed, compacting the ceramic powder between the pins and inner sheath, fixing the pins in position, and the entire swaged assembly is unitized into a single mass.

If the swaged heater assembly is to have heater material pass through the central opening in its inner sheath, the space between the sheaths is sealed, leaving the central opening open. Such sealing can be accomplished with a glue sealant or the like. If the swaged heater assembly is to be a heated melt pot, a sprue bushing, a molding machine nozzle, or in some other form, a suitable ring or disc end 33 in the direction of flow may be welded onto the exit of the assembly, with an appropriate gate or other exit arrangement, if desired. Appropriate leads 26, exterior to the assembly, may be secured to the free ends of the pins. The assembly may also be formed on a lathe or with other components joined as appropriate. Conventional connections to power may be attached to the completed assembly, as desired. The leads 26 can exit at either end of the assembly or at any point on its outer or inner diameter.

The novel open key slot 14 embodying the present invention, distinguished from conventional holes of various shapes used to form a swaged contact, allows extrusion tooling to have a slot portion of the tooling as part of the male portion of an extrusion die, which enables the manufacture of very thin sections while holding precise dimensions and location of the swaged contacts and pins 25. Further this core key slot 14 allows complete filling of all voids between the core 10 and sheaths 29 and 30, even with high dielectric strength powders such as boron nitride to form a portion of the insulation between the pins 25, core 10 and sheaths 29 and 30. This open key slot 14 also permits fixtures equipped with blades to be used in the winding process for expeditiously rotating the core 10.

With referenced to FIGS. 7-8-10, where a thermocouple 35 is desired in the assembly, that thermocouple may have its positive and its negative inserted into adjoining key slots 14 and a jumper wire may be installed between the positive and negative thermocouple elements, before the swaging operation, which locks the thermocouple in place. Such a thermocouple may take the form of ribbon wire. If a thermowell, consisting of a small diameter hvpo-tube, is desired, it may be inserted into one of the key slots 14 or into a special slot (not shown) formed to accommodate it, and it can also be swaged with the entire heater assembly. 44. FIGS. 13-19 show typical heated tool components constructed using the method described in this application and embodying the disclosed invention. FIG. 13 shows an integral heated melt transfer tube 40 for liquid or plastic in isometric form, with parts broken away to show the compacted core 40*a*, with its crushed insulation and slots containing the conductive pins 45 and a temperature control, such as a thermocouple, and the wire winding 40*b*. FIG. 14 shows an integral heated sprue bushing 50 for plastics molding plastic in isometric form, with parts broken away to show the compacted core 50*a*, with its crushed slot containing the conductive pins 55 and a temperature sensor, such as a thermocouple, and the wire winding 50*b*, such a device having a melt channel 51 for delivering melted material and an orifice 52 for entry of the material into a mold. FIG. 15 shows an integral heated melt pot container 60 in isometric form, with parts broken away to show the compacted core 60*a*, with its crushed slot containing the conductive pins 65 and a temperature sensor, such as a thermocouple, and the wire winding 60*b*, and containing a central pot 61 for holding heated material. FIG. 16 shows an integral heated molding machine nozzle 70 in isometric form, similar to FIG. 14, with parts broken away to show the compacted core 70*a*, crushed slot containing the conductive pins 75 and a temperature control, such as a thermocouple, and the wire winding 70*b*, and having a melt channel 71 and orifice 72 for heated melted material.

The inner and outer diameter of the finished compacted swaged heater assembly can be machined to precision tolerances, examples of which are shown in FIGS. 13-19. The ends of the assembly can be formed into flat sealing surfaces as shown in FIG. 17 for use in specialty arrangements, such as in packaging machines requiring the sealing of adhesive coated covers to containers. Such assemblies can be formed into both short and long lengths, and in small and large diameters as required. A wide range of materials for the sheaths 29 and 30 can be employed to provide corrosion resistance, anti-stick properties or oxidation resistance, and the finished devices can be coated as desired. If a larger bottom sealing surface is needed, the novel use of concentric layers of windings and pins can be provided to concentrate and more uniformly balance heat over a larger required end sealing surface as shown in FIG. 18, which can be constructed by telescoping a larger diameter wound core and pin assembly over a smaller wound core and pin assembly, and such a design will also allow independent control of the inner and outer diameters of the end sealing surface. Such assemblies can be readily machined into integral heated roller assemblies for embossing and sealing applications as shown in FIG. 19. Such roller assemblies can be produced in configurations ready for installation of bearings, shafts and drive mechanisms.

Figure 20A:
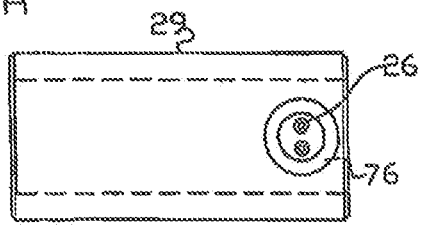
FIGS. 20A-20H illustrate common lead constructions for the devices embodying the invention, the leads being show broken away, and the inside diameter of the inner swaged sheath shown in dotted lines.
Figure 20B:
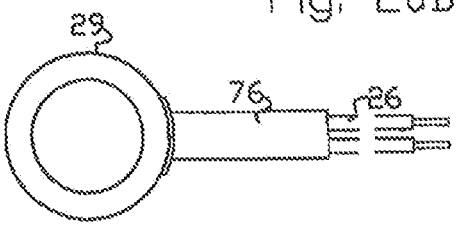
Figure 20C:
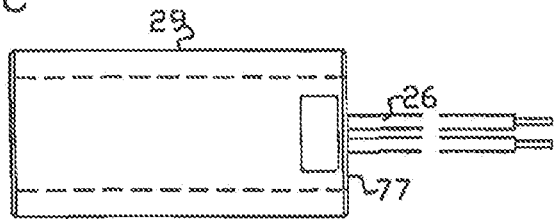
Figure 20D:
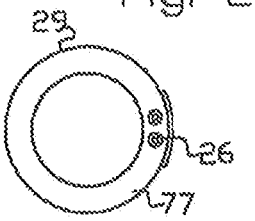
Figure 20E:
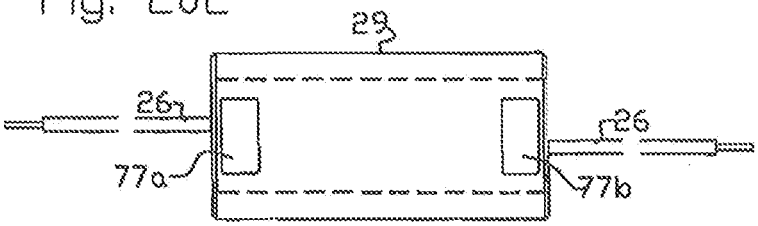
Figure 20F:
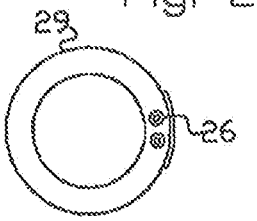
Figure 20G:
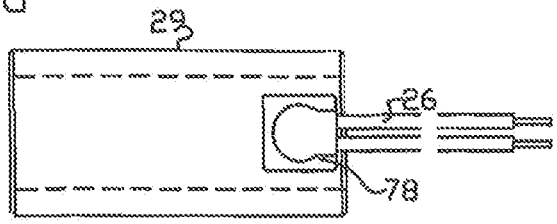
Figure 20H:
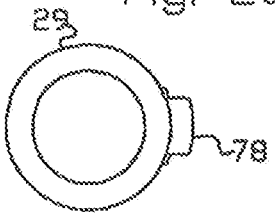

Some, but not all, available lead connection arrangements are illustrated in FIGS. 20A-20H. In FIGS. 20A-20B, the leads extend from the circumference of the swaged outer sheath 29 of the heater where they are connected to the ends of the conductive pins, and the leads 26 may be covered by a protective metal tube 76 or cap. In FIGS. 20C-20D, the leads extend from the end 77 of the swaged heater device between the swaged inner and outer sheaths, 29 and 30, where they are connected to the ends of the conductive power pins 25. In FIGS. 20E-20F, the leads 26 extend from each respective end 77*a* and 77*b* of the swaged heater device. In FIGS. 20G-20H, the leads 26 extend from the swaged outer sheath 29 of the heater through a surface fitting 78 connected to the sheath wall, where they are connected to the ends of the conductive power pins. Other lead connections are also available, the important factor being that the heater construction permits novel power pin-lead connections from almost any point on the heater. A small hole can be ground from the outside of the core through a selected key slot to connect the wire and pins for exit intermediate the core.

Figure 21A:
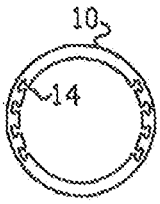
FIGS. 21A-21F shows the steps for making a heater having two or more longitudinally extending cores.
Figure 21B:
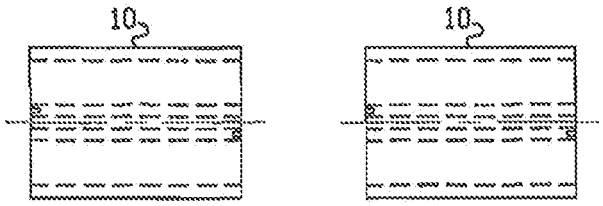
Figure 21C:
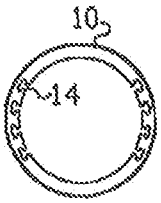
Figure 21D:
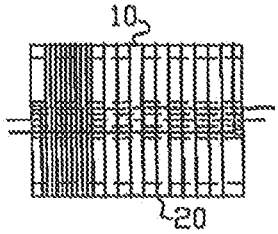
Figure 21D:
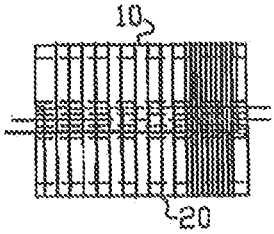
Figure 21E:
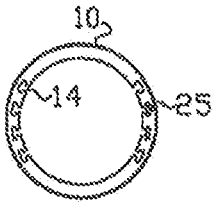
Figure 21F:
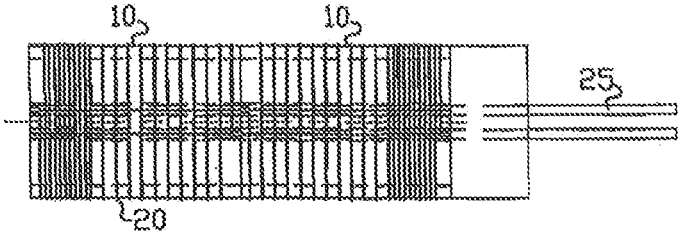

With reference to FIGS. 21A-21F, a sleeve heater with a two core parallel heating element assembly is shown, which can be utilized in multi-core arrangements. The end elevation of the cores 10 is shown FIGS. 21A and 21B shows the side elevation of two like crushable ceramic cores with key slots 14 on each core 10. The end elevation of the cores 10 which have been wound with element heater resistance wire 20 is shown in FIG. 21C, and side elevation of the wire wound cores is shown in FIG. 21D. The end elevation of the wire wound cores 10 with the conductive power pins 25 inserted in the key slots 14 appears in 16F, and the side elevation of the aligned wire wound cores joined by the arrangement of the conductive power pins 25 in the key slots 14 is shown in FIG. 21F. With these multi-core arrangements, power supplies and/or lead arrangements for such structures may be independent or joined.

The intimate association of the heating and heat transfer parts, compacted to a near theoretical density, permits the construction of an effective heated material delivery system with exceptional control, For example, a heated device is shown in the following photograph, having in orange-colored high temperature heated section of the part and in red and in varying red shades in other sections of lesser temperature, all of which can be well controlled by use of the novel devices and method taught in this application.

While this invention has been shown and discussed in considerable detail, it is to be understood that the invention should not be limited to the exact constructions disclosed as many variations are possible and can be made without affecting the nature and scope of the invention

The invention claimed is:

1. A method for making a crushable electric heater core comprising the steps of providing a cylinder-like body of crushable ceramic material; forming longitudinal grooves, each of said grooves having a first end and a second end and an entry, along a periphery of said body, forming slots in said body communicating with said grooves, wherein said longitudinal grooves and said slots when considered in cross-section are key hole like that when considered in cross-section are rectangular or oblong or pillow shaped of greater width than said entry of said key hole like longitudinal grooves, winding electrical heating wire around said body in a direction substantially perpendicular to said grooves; threading the ends of said wire one end into one of said slots and one end into another of each of said slots; and installing conductive pins in said rectangular or oblong or pillow shaped longitudinal grooves said conductive pin being approximately rectangular, one pin in contact with one of said ends and another pin in contact with another of said ends.

2. In the method recited in claim 1, wherein said grooves are narrower at the periphery of said body and enlarged interiorly of said periphery.

3. In the method recited in claim 1, wherein said pins have across section about slightly smaller than said grooves.

4. In the method recited in claim 1, wherein a temperature sensing device is installed in one of said grooves.

* * * * *